US009952009B2

(12) United States Patent
Buchel et al.

(10) Patent No.: US 9,952,009 B2
(45) Date of Patent: Apr. 24, 2018

(54) HYBRID LEFT HANDED 1911 PISTOL

(71) Applicant: Big Horn Armory, Inc., Cody, WY (US)

(72) Inventors: Gregory E. Buchel, Cody, WY (US); Daniel Brown, Cody, WY (US)

(73) Assignee: Big Horn Armory, Inc., Cody, WY (US)

( * ) Notice: Subject to any disclaimer, the term of this patent is extended or adjusted under 35 U.S.C. 154(b) by 0 days.

(21) Appl. No.: 14/919,220

(22) Filed: Oct. 21, 2015

(65) Prior Publication Data

US 2016/0109207 A1 Apr. 21, 2016

Related U.S. Application Data

(60) Provisional application No. 62/066,582, filed on Oct. 21, 2014.

(51) Int. Cl.

| | |
|---|---|
| ***F41C 3/00*** | (2006.01) |
| ***F41A 15/00*** | (2006.01) |
| ***F41A 19/13*** | (2006.01) |
| ***F41A 21/00*** | (2006.01) |
| ***F41A 3/66*** | (2006.01) |
| ***F41A 15/12*** | (2006.01) |

(52) U.S. Cl.

CPC ..... *F41A 3/66* (2013.01); *F41A 15/12* (2013.01)

(58) Field of Classification Search

CPC .... F41A 5/00; F41A 5/04; F41A 15/00; F41A 15/12; F41A 15/14; F41A 19/30; F41A 35/06; F41A 99/00; F41A 3/66; F41C 3/00

See application file for complete search history.

(56) References Cited

U.S. PATENT DOCUMENTS

| | | | | |
|---|---|---|---|---|
| 1,618,510 | A * | 2/1927 | Browning | F41A 5/04 42/7 |
| 2,744,448 | A * | 5/1956 | Allen | F41A 3/54 42/69.03 |
| 3,477,162 | A * | 11/1969 | Morse | F41A 15/14 42/25 |
| 6,345,463 | B1 * | 2/2002 | Baer, Sr. | F41C 27/22 42/7 |
| 6,347,569 | B1 * | 2/2002 | Butler | F41A 19/15 42/16 |
| 6,722,074 | B1 * | 4/2004 | Farrell | F41G 11/003 42/124 |
| 9,341,429 | B1 * | 5/2016 | Reavis, III | F41A 35/02 |
| 2012/0291324 | A1 * | 11/2012 | Bandini | F41A 5/04 42/14 |

(Continued)

OTHER PUBLICATIONS

John Caradimas, M-1911 Pistol History, downloaded Jul. 6, 2016, internet pubication, entire document, found here: http://www.m1911.org/full_history.htm.*

(Continued)

*Primary Examiner* — Bret Hayes
(74) *Attorney, Agent, or Firm* — Warn Partners, P.C.

(57) ABSTRACT

A left handed handgun which allows the use of conventional right handed unmodified magazines. The handgun assembly is adapted for left handed operation including the frame, slide, ejector, firing pin stop area, and extractor to accommodate the left handed user and eject empty cartridge cases away from the left handed user.

18 Claims, 4 Drawing Sheets

(56) References Cited

U.S. PATENT DOCUMENTS

| | | | | |
|---|---|---|---|---|
| 2013/0019510 | A1* | 1/2013 | Kemmerer | F41A 17/20 42/1.01 |
| 2014/0224114 | A1* | 8/2014 | Faxon | F41A 15/14 89/193 |
| 2014/0338243 | A1* | 11/2014 | La Vigne | F41A 35/06 42/16 |
| 2015/0219413 | A1* | 8/2015 | Karimullah | F41A 9/01 89/132 |

OTHER PUBLICATIONS

1911Forum.com, left handed 1911 thread, downloaded Jul. 6, 2016, internet publication, at least comments #3 and #6, p. 2, found here: https://forums.1911forum.com/showthread.php?t=218619.*

The High Road, 1911 left hand slide, downloaded Jul. 6, 2016, internet publication, at least TRX's disclosure, p. 1, found here: http://www.thehighroad.org/archive/index.php/t-626264.html.*

Corporate Author, 1911 Government Schematic, The Internet Archive Wayback Machine, found here, https://web.archive.org/web/20130827022122/http://www.midwayusa.com/General.mvc/Index/Schematics~Gov1911, shows this schematic dating from Aug. 27, 2013, pp. 1-3.*

* cited by examiner

HYBRID LEFT HANDED 1911 PISTOL

CROSS-REFERENCE TO RELATED APPLICATIONS

This application claims the benefit of U.S. Provisional Application No. 62/066,582, filed Oct. 21, 2014. The disclosure of the above application is incorporated herein by reference.

FIELD OF THE INVENTION

The present invention relates to a 1911 style handgun.

BACKGROUND OF THE INVENTION 1911 handguns are one of the most popular handguns, possibly of all times. The 1911 handguns (also commonly referred to as "Model 1911" or "M1911" et seq.) are commonly used for self defense and/or competition, and many parts are available to modify these firearms to an individual user's preferences.

However, the 1911 handgun is predominantly a design specifically used for shooting in the right hand. While the firearm can be fired by a left-handed individual, the user must either use it right handed or use the firearm in the user's left hand but suffer the unsafe and inconvenience of shell casings ejected from the right hand facing port flying in front of (or on occasion into) the user's head and line of sight.

Some left handed 1911 style handguns have been attempted. But the modifications have been significant and expensive and have not allowed much interchangeability in parts with right hand versions. In particular, none of the known versions allow the use of even one of the millions of military surplus and civilian magazines available in the marketplace today.

It is believed that because of these shortcomings there has not been a successful commercial launch of a left handed version of the 1911 in the marketplace today. Therefore, there remains a need in the art for an easily manufactured left hand 1911 that uses the same readily available magazines as the millions of right hand 1911 handguns combined with the safety aspects of shell casings being ejected away from the shooter.

SUMMARY OF THE INVENTION

A pistol having an ejection port in the slide, an extractor, and an ejector that are all reversed position for left-handed use. All other elements, including control surfaces and control contact points of the pistol remain the same. The reversed ejection port, extractor and ejector force ejected empty cartridges cases generally in the opposite direction from the user's face. Keeping the control surfaces and control contact points the same allows for use of standard magazines, e.g., right handed firearm magazines, which are plentiful and inexpensive. The combination of the reversed ejection port, extractor and ejector along with the use of the existing control surfaces and contact points has significant advantages over other pistols, e.g., any left handed 1911 pistols, which are complete mirror images forcing the use of non-standard magazines.

Thus, the present invention gives a left-handed user all of the advantages of a right handed pistol to a right handed user (e.g., ejects empty cases generally away from the face of the user) and provides all of the traditional functions of a 1911 pistol, and, is capable of using standard 1911 cartridge magazines.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
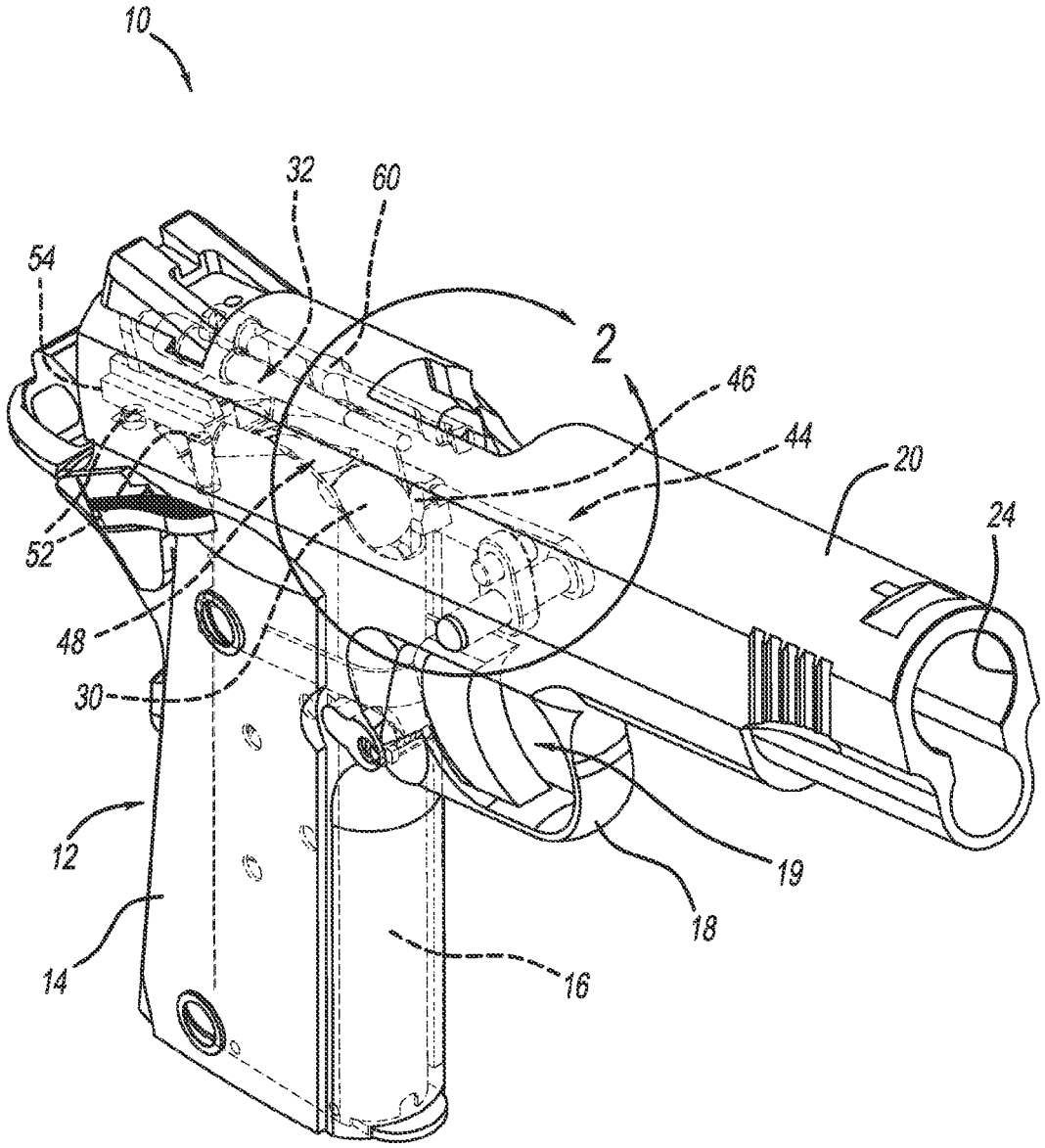
FIG. 1 is a perspective view, with portions in phantom, of the left handed 1911 handgun of the present invention.
Figure 2:
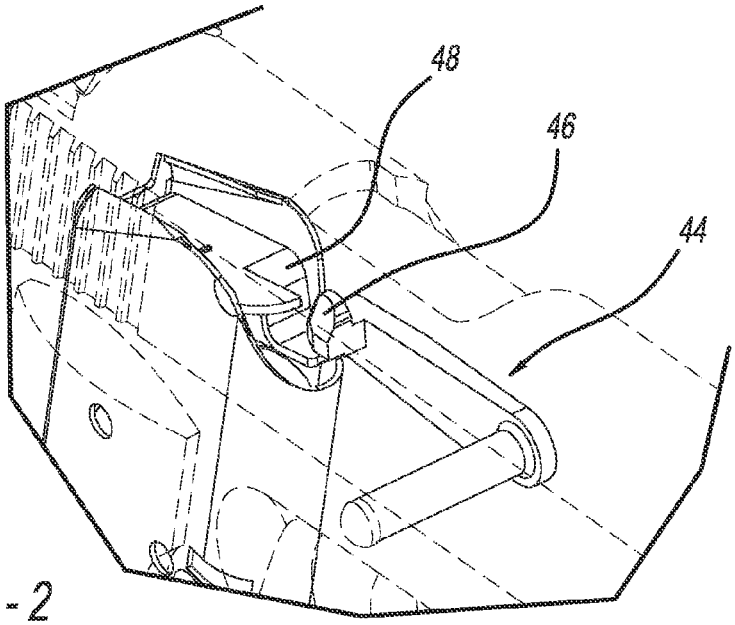
FIG. 2 is a detailed perspective view of portions of detail "2" taken from FIG. 1 according to the present invention.
Figure 3:
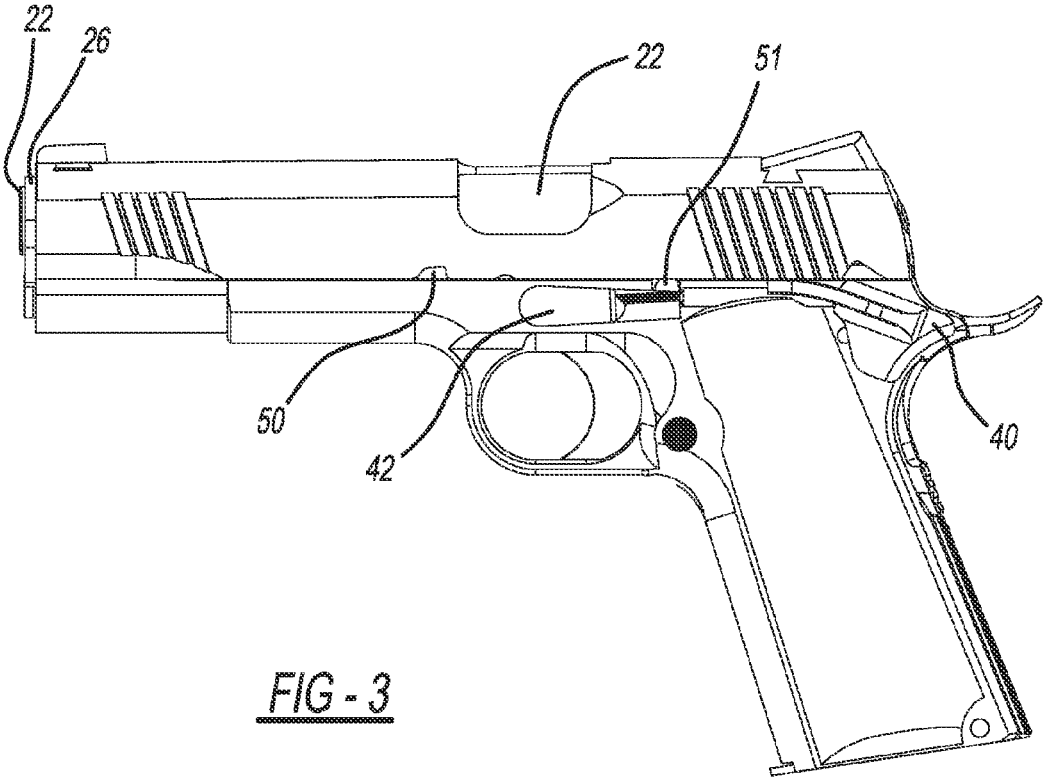
FIG. 3 is a side view of the left handed 1911 handgun of the present invention.
Figure 4:
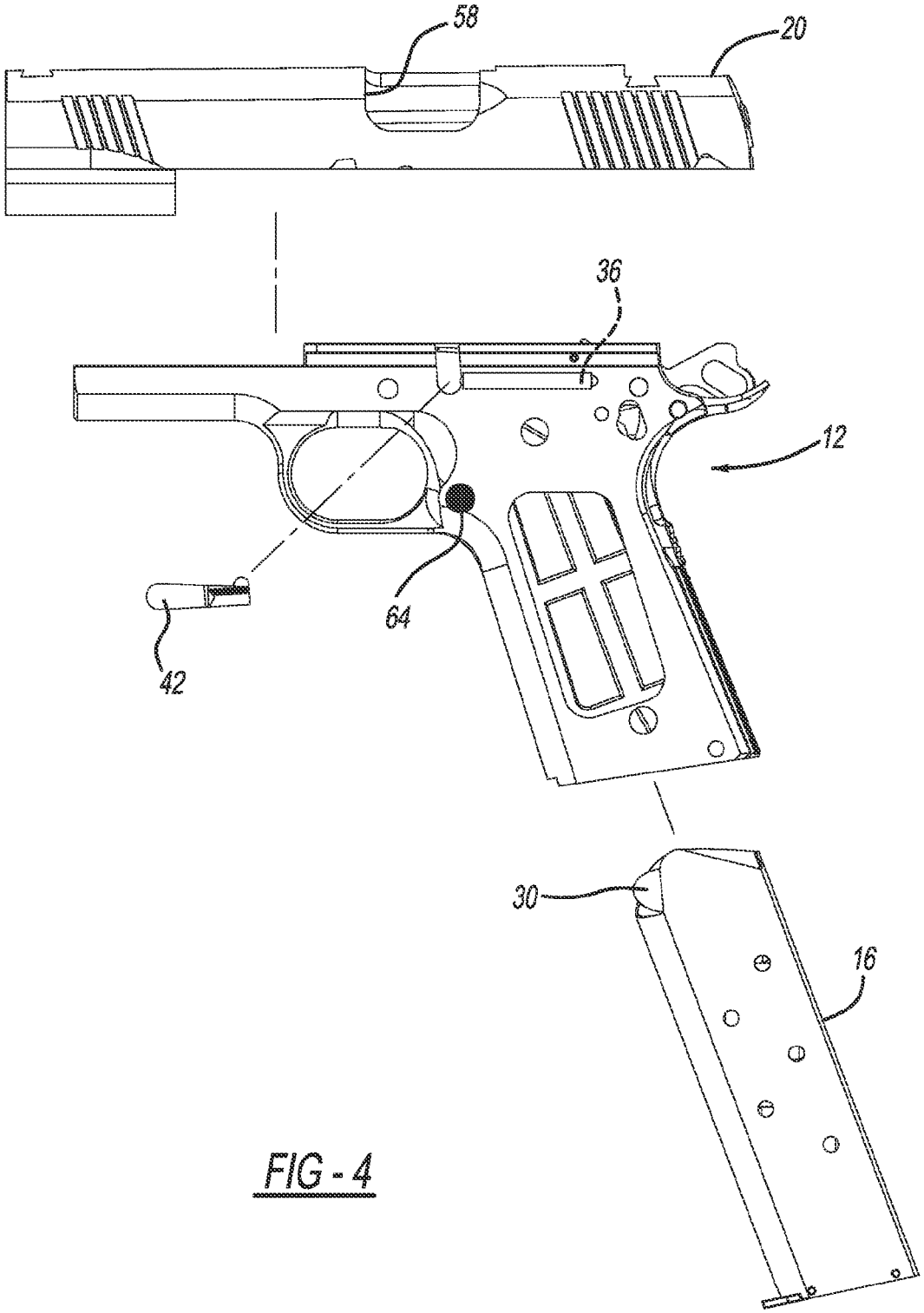
FIG. 4 is a partial exploded view of the left handed 1911 handgun of the present invention.

The following description of the preferred embodiment(s) is merely exemplary in nature and is in no way intended to limit the invention, its application, or uses.

The present invention is directed to a hybrid left handed 1911 pistol for the left handed, left eye dominant user. The pistol illustrated is a semi-automatic 1911 pistol. However, the pistol can be any other pistol or firearm without departing from the scope of the present invention. The present invention eliminates the dangerous and distractive empty case ejections that are common to left handed users using right handed pistols. It also eliminates the need for expensive proprietary magazines and allows the left handed user to use standard, right handed magazines, which is yet another significant benefit of the present invention.

There is provided a hybrid left handed 1911 pistol shown generally at 10 capable of ejecting empty cartridge cases generally to the left, away from the face of the left handed user. This eliminates the dangerous problem of ejected cases being ejected into the face of the left handed user and also eliminates the distraction of empty cases being ejected across the sight line of the left handed user.

In general, standard right handed magazines are readily available. The hybrid left handed 1911 pistol 10 allows the use of these standard right handed 1911 magazines, which eliminates the use of expensive proprietary magazines that would only work in true mirror image left handed pistols.

Referring to the present invention in general, in operation, the standard magazine is the device that carries the cartridges and when inserted into the grip opening in the frame directs the cartridges to feed into the barrel's chamber. There are millions of these in common usage. The cartridge is the assembly that contains the primer, powder, case and bullet. The primer is the enclosure which contains the explosive compound which when struck ignites the powder and begins the process whereby the bullet leaves the firearm's barrel. The case is the component that holds the primer, powder and bullet, the bullet being the projectile that leaves the firearm's barrel. The frame is the main component of the firearm assembly; it holds all of the firearm parts together. Also called the receiver. The ejector is the component that is attached to the frame that causes the empty case to be thrown from the firearm, via the ejection port. The extractor device pulls the empty case from the barrel when the slide is retracted. The slide is the portion of the firearm assembly that contains the barrel, firing pin and ejector; it moves when the firearm is fired to create the motion required to cycle the firearm, ejecting the empty case and loading a fresh cartridge into the barrel's chamber. The chamber is the void in the barrel where the unfired cartridge resides prior to being fired. And the slide stop is the component which locks the slide in the fully rearward open position when the magazine is empty of cartridges. The magazine follower activates the slide stop into the upward position. This forces the end of the slide stop into a recess in the slide, locking it into position.

Referring to FIGS. 1-5 generally, the hybrid left handed 1911 pistol assembly 10 includes a frame portion generally shown at 12, also referred to interchangeably as "receiver", having a hand grip portion 14, or "stock", where a removable cartridge magazine 16 is also received therein, and a trigger guard portion 18 for the trigger of a trigger assembly generally indicated at 19. A slide portion 20 is slideably mounted to the top of the frame 12 and selectively removable. A barrel 22 is generally removably provided within a bore or channel 24 of the slide 20 and generally guided by a barrel bushing 26 located within a firing end region of the slide 20. The barrel 22 is operable to move relative to the frame 12 with the motion of the slide 20. The barrel 22 also has a chamber 28 into which cartridges 30 from the magazine 16 are sequentially fed. A firing pin assembly shown generally at 32 including a firing pin spring is located along the rear section of the slide 20 and against a firing pin stop 34. A spring plunger 36 is provided to engage/detent, e.g., to prevent the firing pin 32 from coming into engagement with the cartridge 30 when the firing pin assembly 32 is properly engaged with a hammer assembly indicated generally at 38.

The hybrid left handed 1911 pistol assembly 10 also has a safety 40 and a left side slide stop 42, both of which are standard. The safety 40 on the left side can be manipulated by the left hander's thumb, and, the slide stop 42 can be manipulated by the user's trigger finger. The slide stop 42 is part of a slide stop assembly shown generally at 44 including a slide stop protrusion 46 adjacent a magazine follower 48 of the magazine 16, all of which are standard. A tab 51 of the slide stop 42 selectively engages a notch in the slide and a standard recess 50 formed on the slide 20.

The slide rail slots, the slide stop cut, and a slide stop relief cut remain the same as in the right handed firearms.

The slide stop assembly 44 remains the same as in the right handed firearms. This allows the standard right handed magazine 16 to perform its function to lock the slide 20 in the rearward position when the magazine 16 is empty. This is a standard feature of the 1911 pistol and must be maintained for proper operation in its manual of arms. A standard depressible magazine release button 64 is also provided to release the magazine 16 for removal from the grip portion 14 of the frame 12.

The left side position of the pistol assembly 10 controls are better for manipulation by the left handed user because the left hander's trigger finger can operate the magazine release button 64 and the slide stop 42 generally without having to change the user's grip on the hand grip portion 14 of the handgun 10. This has significant safety and grip stability advantages. In contrast, almost all right handed users of original right handed controls for conventional handguns must release their grip to effect these control movements because the controls are on the left side.

In order to accommodate left handed operation, the present invention includes particular adjustments to the frame 12, slide 20 and other features as will now be explained in more detail.

The frame 12 has a pair of apertures 52 located on the opposite side of the top of the frame 12 relative to right handed pistols. The pair of apertures 52 are provided toward the top of the frame 12 to receive and hold posts of an ejector 54. The slide 20 is provided with a rear slide stop 56 area having an opening to a channel 57 formed in the slide 20 to retain the ejector 54. The ejector 54 and first channel 57 are mirror image reversed relative to right handed pistols to allow left side ejection. This combination of features has significant benefits over conventional systems.

Preferably, the firing pin stop 34 also includes a recess 35 mirror image to the right hand firearms.

The slide 20 is also mirror image reversed on the upper portion of the slide, e.g, upper 90%, except for the barrel and barrel bushing cuts. These remain the same as the right handed firearm and are not reversed. An ejection port 58 (see FIG. 4) is provided on the opposite side of the slide 20 as the ejector 54. This is significant in that it allows the empty cartridges to eject to the left, away from the face and line of site of the left hand shooter.

An extractor 60 is also provided, which generally pulls the cartridge back on the slide 20 and ejects spent cartridges. The extractor 60 is retained in the slide 20 by the rear slide stop 56 section. A second channel 62 is provided in the rear slide stop area 56 to receive the extractor 60. The Extractor 60 is mirror image reversed to allow for left side ejection. The firing pin stop 34 and rear slide stop area 56 are also mirror image reversed to allow containment of the extractor 60 and to accommodate the reversed ejector 54.

The combination of all of these features creates a unique design with the necessary functions for safety and comfort for the left handed operator, while maintaining the affordability of utilizing standard magazines.

The present invention is not limited to 1911 pistols. Other models, side arms, pistols, handguns, firearms, magazines and etc of any kind incorporating left handed features according to the invention and/or compatible with various magazines and/or caliber cartridges are contemplated without departing from the scope of the present invention.

Figure 5:
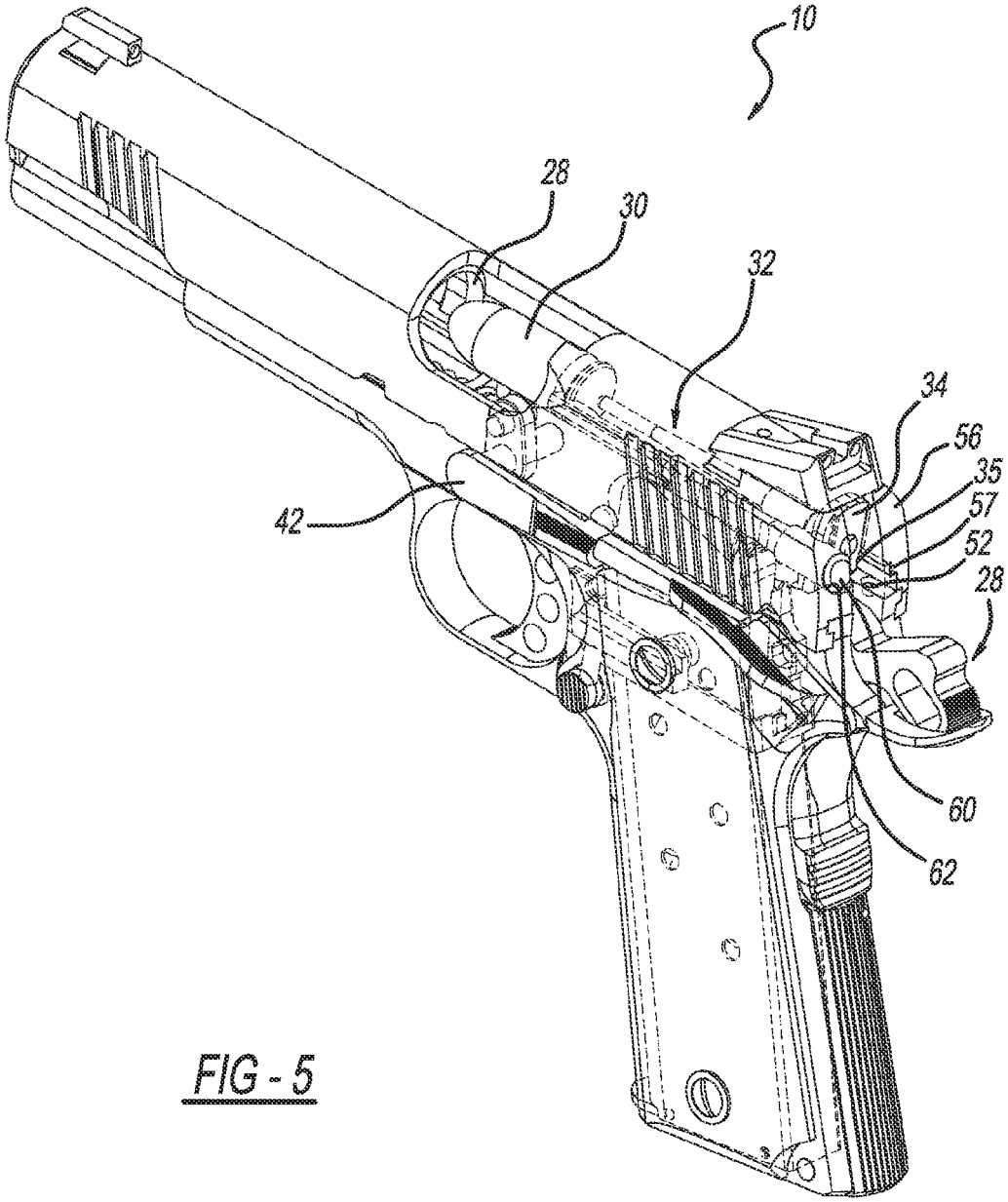
FIG. 5 is a rear perspective view of the left handed 1911 handgun of the present invention.

Referring to the Figures generally, and most particularly to FIG. 5, for reference, it is understood that with the longitudinal axis as taken from the rear stop area 56 in the direction toward the bushing 26, the right side of the pistol is generally to the right relative this axis, and the left side of the pistol is generally to the left relative to the axis.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A single barrel 1911 handgun that uses right handed handgun 1911 conventional magazines, consisting essentially of:

said handgun having a single barrel with an open end for pointing away from a user and defining a left hand side of the handgun and a right hand side of the handgun when said open end of said barrel is pointed away from said user;

a frame having a single magazine well operable to receive a single stack of the right handed handgun 1911 conventional magazine holding a plurality of cartridges and having a single stack magazine follower, said frame including a magazine release button on the left side of the frame connected to a magazine ejection mechanism cooperating on the right side of the magazine well with said right handed 1911 conventional magazine having a right side magazine catch orifice for retention and release of said right handed 1911 conventional magazine from said magazine well on the handgun by depressing said magazine release button, said frame including a slide release lever on the left hand side of said frame;

a slide including an ejection port on the same left hand side of the frame of the handgun as the slide release lever and magazine release button which is leftward facing with respect to a longitudinal axis of the slide from a perspective of a left handed user of the handgun holding the handgun in the left hand with the open end of the barrel pointed away from the user and firing in a direction away from the user;

an internal extractor adjacent the ejector port;

an ejector located rightwardly of the internal extractor with respect to the longitudinal axis and coupled to the frame, said ejector operable to cause an empty casing to eject leftward from the handgun via the leftward facing ejection port; and a first channel on the right hand side of said slide adjacent the ejection port for receiving the ejector and a second channel that is on the slide to receive the internal extractor on the same side of the slide as the left side ejector port.

2. The 1911 handgun of claim 1, wherein the handgun is operable for left handed firing, said ejector causing the empty casing to be thrown from the handgun in a direction away from a left handed user.

3. The 1911 handgun of claim 2, wherein the extractor and ejector are mirror image reversed from right handed 1911 handguns.

4. The 1911 handgun of claim 3, wherein the upper portion of the slide is mirror image reversed from right handed 1911 handguns.

5. The 1911 handgun of claim 1, wherein the first and second channels are mirror image reversed from right handed 1911 handguns.

6. The 1911 handgun of claim 1, further comprising a pair of holes in the top of the frame to receive and hold the ejector in the first channel of the slide.

7. The 1911 handgun of claim 1, further comprising a slide stop assembly, that is the same as right handed 1911 handguns, operable to allow right handed 1911 conventional magazines to lock the slide in a rearward position when the magazine is empty.

8. The 1911 handgun of claim 7, further comprising a magazine follower, that is the same as right handed 1911 handguns, operable to activate a protrusion of the slide stop assembly into an upward position, which forces an adjacent end of the slide stop into a recess that is toward the bottom edge of the slide.

9. The 1911 handgun of claim 1, further comprising a firing pin and a barrel, wherein the extractor pulls the empty casing from the barrel when the slide is retracted.

10. A single barrel 1911 pistol, consisting essentially of:

a barrel with an open end for pointing away from a left hand user and defining a left hand side of the pistol having an ejection port and a right hand side of the pistol when said open end of said barrel is pointed away from said left hand user;

a frame including a grip portion frame having a single magazine well operable to receive and hold a single right handed handgun 1911 conventional magazine having one or more cartridges and a single magazine follower, said frame including a magazine release button on the left side of the frame connected to a magazine ejection mechanism cooperating on the right side of the magazine well with said right handed 1911 conventional magazine having a right side magazine catch orifice for retention and release of said right handed 1911 conventional magazine from said magazine well on the pistol by depressing said magazine release button, said frame including a slide release lever on the left hand side of said frame;

a slide operably slideably coupled to the frame;

said ejection port is provided on the slide on the same left hand side of the frame of the pistol as the slide release and magazine release button, which is leftward facing from the perspective of the left-handed user of the pistol with respect to a longitudinal axis of the slide parallel to the barrel firing direction away from the user;

an internal extractor device adjacent the barrel on the same left side of the frame as the election port; and an ejector device located rightwardly of the internal extractor and coupled to the frame on the left hand side of the frame;

wherein at least the ejector device, internal extractor device and ejection port are located operably to cause an empty casing to eject from the ejection port of the pistol in a leftward direction relative to the user holding the pistol in the left hand.

11. The 1911 pistol of claim 10, further comprising a first channel that is formed in the slide to receive the ejector device.

12. The 1911 pistol of claim 11, further comprising a second channel that is formed in the slide to receive at least an end portion of the extractor device, wherein the first and second channels are mirror image reversed from right handed 1911 handguns.

13. The 1911 pistol of claim 10, further comprising a pair of holes in the top of the frame to receive and hold the ejector device in the slide.

14. The 1911 pistol of claim 13, wherein the pair of holes on the frame and the ejection port on the slide are located in opposite positions from that of right handed 1911 handguns.

15. The 1911 pistol of claim 10, further comprising a slide stop assembly operable to allow right handed 1911 conventional magazines to lock the slide in a rearward position when the magazine is empty.

16. The 1911 pistol of claim 15, further comprising a magazine follower operable to activate the slide stop assembly into an upward position, which forces the slide stop into a recess of the slide.

17. A single barrel pistol assembly including leftward facing features and uses right handed conventional magazines, comprising:

a receiver having a single magazine well operable to receive the right handed conventional magazines, said receiver including a magazine release button on the left side of the receiver connected to a magazine ejection mechanism cooperating on the right side of the magazine well with said right handed conventional magazine having a right side magazine catch orifice for retention and release of said right handed conventional magazine from said magazine well on the pistol by depressing said magazine release button, said receiver including a slide release lever on the left hand side of said receiver;

a pair of holes formed in an upwardly facing surface of the receiver;

a barrel including a barrel chamber, said barrel having an open end for pointing away from a user and defining the left side of the pistol and the right side of the pistol when said open end of said barrel is pointed away from said user;

a firing pin device adjacent a firing pin stop;

an ejector device operably coupled to the receiver by the pair of holes;

a slide, said slide containing the barrel, firing pin device and ejector device; and an internal extractor device, said extractor device operable to pull an empty casing from the barrel chamber; and an ejection port on the slide on the same left hand side of the receiver of the pistol as the slide release and magazine release button, and which is leftward facing;

a slide stop assembly on the left hand side of the slide and operable to allow the magazine to lock the slide in a rearward position when the magazine is emptied of cartridges, wherein the slide stop assembly has a slide stop on the left side of the pistol assembly for selective manipulation by a left-handed user with the user's left hand without said user fully removing said user's grip on the pistol portion to release the magazine;

a magazine follower within the magazine operable to activate a portion of the slide stop assembly into an upward position, which forces the slide stop into a recess of the slide for holding position; and said magazine release button located on the left side of a grip portion of the frame for selective manipulation by the user with the user's left hand without said user fully removing said user's grip on the pistol portion to release the magazine;

wherein at least the ejector device and internal extractor device and ejection port are operably located in the receiver to cause the ejected empty casing leaving the ejection port of the pistol to travel in a leftward direction away from the user holding the pistol assembly in the left hand with said opening pointed away from said user.

18. The pistol assembly of claim 17, further comprising a first channel formed in the slide to receive the ejector device; and a second channel formed in the slide to receive at least an end portion of the extractor device;

wherein the first and second channels are mirror image reversed from right handed 1911 handguns.

* * * * *